United States Patent [19]

Hancock

[11] 3,936,989

[45] Feb. 10, 1976

[54] INTERLOCKING BUILDING BLOCK

[76] Inventor: Norman Lee Hancock, 10439 Garibaldi St., St. Louis, Mo. 63122

[22] Filed: Feb. 10, 1975

[21] Appl. No.: 548,882

[52] U.S. Cl. ..... 52/593; 52/603; 52/605

[51] Int. Cl.[2] ..... E04B 2/56; E04C 1/04

[58] Field of Search ..... 52/589–595, 52/603–607, 747; 46/25

[56] References Cited

UNITED STATES PATENTS

| | | | |
|---|---|---|---|
| 1,115,542 | 11/1914 | Hudson | 52/591 X |
| 1,472,911 | 11/1923 | Hundley | 52/591 |
| 2,619,829 | 12/1952 | Tatum | 52/591 |
| 3,012,377 | 12/1961 | Sunukjian | 52/603 X |
| 3,427,774 | 2/1969 | Curtis | 52/605 X |
| 3,795,079 | 3/1974 | Klem | 52/603 |

FOREIGN PATENTS OR APPLICATIONS

| | | | |
|---|---|---|---|
| 760,804 | 11/1956 | United Kingdom | 52/591 |

*Primary Examiner*—J. Karl Bell

*Attorney, Agent, or Firm*—Cohn, Powell & Hind

[57] ABSTRACT

This building block includes upper and lower sides having longitudinally extending ribs and grooves respectively interfitting with the grooves and ribs of compatibly formed blocks. The ribs and grooves include spaced faces inclined in the same general direction and interconnected by a transverse flat face. In the building wall construction corner blocks are provided having a partial rib and full groove; end blocks are provided having a partial groove and no rib, and cap blocks are provided having a full groove and no rib.

14 Claims, 13 Drawing Figures

INTERLOCKING BUILDING BLOCK

BACKGROUND OF THE INVENTION

This invention relates generally to building walls formed from interlocking building blocks and particularly to building blocks having asymmetrical rib and groove construction.

There have been numerous attempts to improve building wall construction by utilizing molded interlocking blocks which do not require mortar joints but rely rather on the structural interengagement of block parts to stabilize the wall.

Two disadvantages of existing systems are to be found in the fact that the individual blocks are either relatively complicated or else more than one type of basic block is required. Another disadvantage lies in the fact that known molded block systems are not readily adapted to produce a visual appearance which is comparable to the common brick either with respect to size or the building bond which may be achieved.

The present block overcomes these and other disadvantages in a manner not disclosed in the known prior art.

SUMMARY OF THE INVENTION

The basic building block used in the wall construction herein does not require mortar joints to ensure the stabilization of the wall but provides a building block having an interlocking means which resists separation of the blocks under load.

Although modifications of the basic block are utilized for corner, end and cap construction, the basic blocks used in the wall construction are identical to each other.

The speed of construction is considerably increased because of self-aligning structural arrangement of building block parts. The particular interlocking rib and groove feature provided by the blocks does not interfere with the external appearance and the blocks are readily adaptable so that they provide a brick and mortar appearance.

The blocks are particularly susceptible to end molding techniques and are sufficiently simple in configuration to ensure that they can be inexpensively manufactured and laid without special instruction.

It is a primary object of this invention to provide a building block having an upper side which includes a longitudinally extending rib having first and second laterally spaced faces interconnected by a transverse face, the intersection between said transverse face and said first inclined face and said transverse face and said second inclined face defining acute and obtuse angles respectively; and a lower side which includes a longitudinally extending groove having laterally spaced first and second inclined faces interconnected by a transverse face, the intersection between said transverse face and said first and second faces respectively defining an acute included angle and an obtuse included angle so that said groove receives the rib of a compatible block in interfitting relation.

It is another object to provide that the acute included angles of the rib and groove are substantially equal and that the obtuse included angle of the rib and groove are substantially equal and to provide that the mouth of the groove is slightly wider than the rib.

A further object is to provide that the sum of the acute and obtuse included angles of both the rib and the groove are less than one hundred and eighty degrees so that the first and second inclined faces of the rib converge outwardly and the first and second inclined faces of the groove converge inwardly.

Still another object is to provide that the upper side of the block includes longitudinally extending flanking portions, contiguously adjacent each rib and each groove that are sloped downwardly away from said rib and groove respectively.

Yet another object is to provide a building block having a front side which includes a substantially rectangular brick-simulating panel, defined in part by relatively recessed right-angularly related margin portions on two margins only.

Another object of this invention is to provide said block with front and rear sides and ends which are substantially vertical one of said ends including relatively outstanding bearing portions engageable with the other of said ends.

It is a further object to provide a second building block similar to the first building block except that the rib extends only one half of the length of the block.

Still another object is to provide a third building block only half the size of the first building block and having neither ribs nor grooves.

Yet another object is to provide a cap block having a groove but a flat face in lieu of a rib.

It is yet another object to provide a fourth building block having a partial groove and no rib.

It is an important object of this invention to provide a building wall construction consisting primarily of a plurality of first blocks laid in alternating tiers in common bond; said wall having a corner construction provided by a combination of said second and third blocks, a cap construction provided by said cap blocks, and an end construction provided by a combination of said third and fourth blocks.

DESCRIPTION OF THE PREFERRED EMBODIMENT

Figure 1:
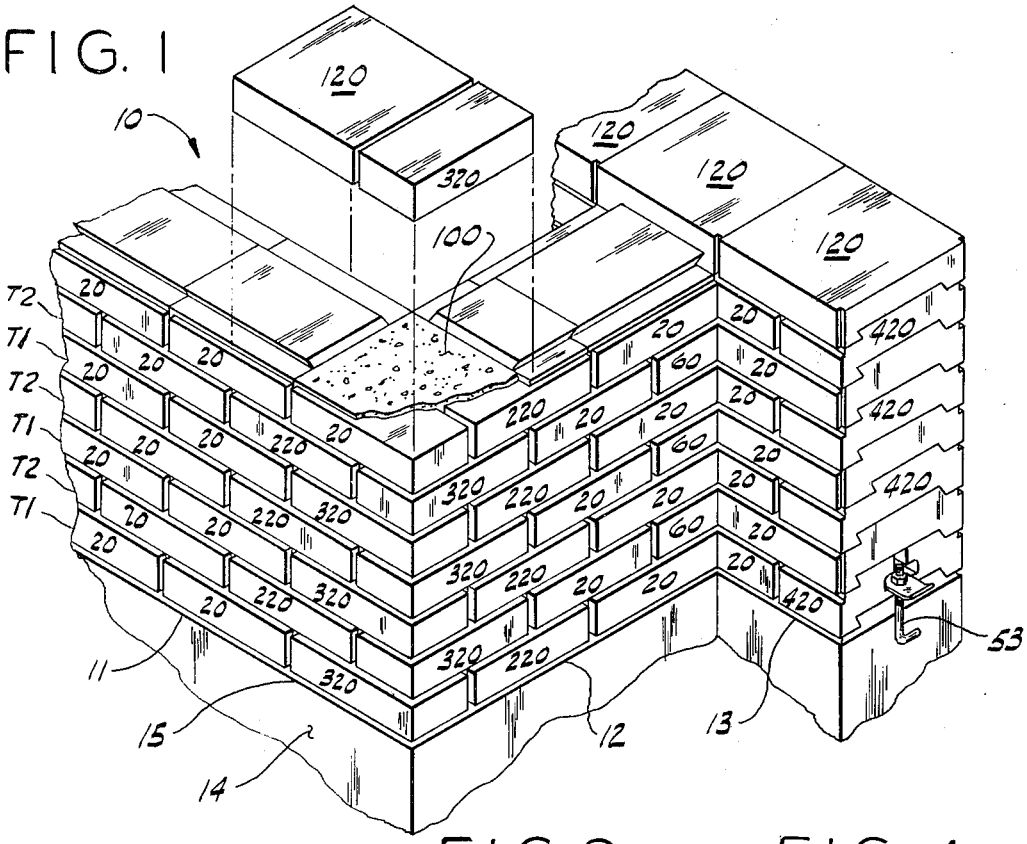
FIG. 1 is a perspective view of a building wall constructed from the interlocking building blocks.
Figure 2:
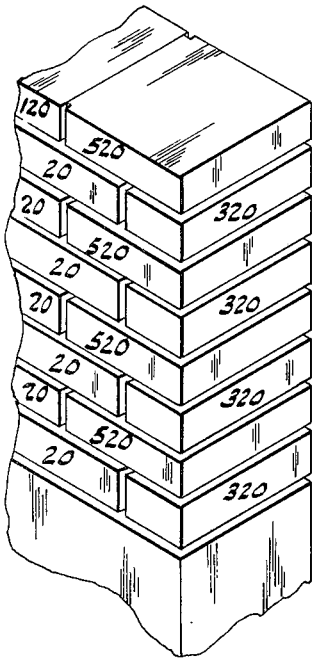
FIG. 2 is a fragmentary perspective view of an end wall construction.
Figure 3:
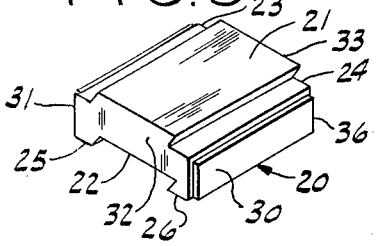
FIG. 3 is a perspective view of a basic building block.

Referring now by characters of reference to the drawing and first to FIGS. 1 and 3 it will be understood that the building wall 10 shown in FIG. 1 is constructed primarily of a basic building block 20 which is illustrated in FIG. 2. For exemplary purposes, the wall 10 is shown as comprising perpendicularly related wall sections 11 and 12 and a parallel wall section 13. In general, the sections 11, 12 and 13 are formed from a plurality of tiers of vertically staggered blocks laid on a foundation 14 over a mortar pad 15. Block 20 will be described first and the cap blocks, corner blocks, end blocks and other variations of said basic block 20, necessary to complete the wall 10, will be described later.

As shown by reference to FIG. 3 and FIGS. 9–11, each block 20 includes a rib 21 and a groove 22, both extending longitudinally substantially the entire length of the block. The rib 21 and the groove 22 are formed so that the rib 21 can be received within the groove 22 of a compatibly formed block. The rib 21 and contiguous, downwardly sloped flanking portions 23 and 24 form the upper portion of the block 20. The groove 12 and contiguous, downwardly sloped flanked portions 25 and 26 form the lower portion of the block 20. It will be understood that the downward slope of the flanking portions precludes the retention of rainwater on these surfaces. The block 10 further includes front and rear portions 30 and 31 and end portions 32 and 33. Each of the sides 30 and 31 includes right-angularly related, recessed margin portions 34 and 35, which provide mortar-simulating strips and define a substantially rectangular brick-simulating facing panel 36, about the size of a common brick.

Importantly, the rib 21 and the groove 22 are configurated to interlock in such a manner that the bending resistance offered to forces applied to the front of the wall 10 is considerably greater than it is to forces applied on the other side of said wall. To this end, and as shown clearly in FIGS. 9–11, the rib 21 includes a transverse face 40 which extends between laterally spaced faces 41 and 42. The spaced faces 41 and 42 constitute first and second faces and are inclined in the same general direction at angles A and B respectively measured clockwise from a horizontal line 48. This geometrical arrangement provides that the intersection between said transverse face 40 and said first face 41 defines an acute included angle, and provides further that the intersection between said transverse face 40 and said second face 42 defines an obtuse included angle. Similarly, the groove 22 includes a transverse face 43 extending between laterally spaced faces 44 and 45. Said spaced faces 43 and 44 constitute first and second faces said faces being inclined in the same general direction at angles A and B so that the intersection between said transverse face 43 and said first face 44 defines an acute included angle and the intersection between said transverse face 43 and said second face 45 defines an obtuse included angle. In the preferred embodiment angles A of the rib 21 and the groove 22 are identical and angles B of the rib 21 and the groove 22 are identical. However, angles A and B are not equal and in the preferred embodiment angle A is greater than angle B so that the rib spaced faces 41 and 42 converge outwardly and the groove spaced faces 44 and 45 converge inwardly. Both angles A and B are less than right angles, but because angle A is greater than angle B the sum of the acute and obtuse included angles is greater than two right angles. Angles of 76° (A) and 70° (B) have been used.

The mouth of the groove 22, which is defined by the distance L is greater than the maximum width of the rib 21, which is defined by the distance L′. This geometrical arrangement facilitates entry of the rib 21 within said groove 22. In the preferred form of manufacture, an end mold is used, which is indicated in phantom outline by numeral 46. The above described relationship between angles A and B ensures that the wear on the mold which tends to be excessive at obtuse angles is compensatory in nature and results in a prolonged mold life, particularly when the block 20 is removed from the molds by end movement. A length L′ one-sixteenth in. less than L has been used.

Figure 10:
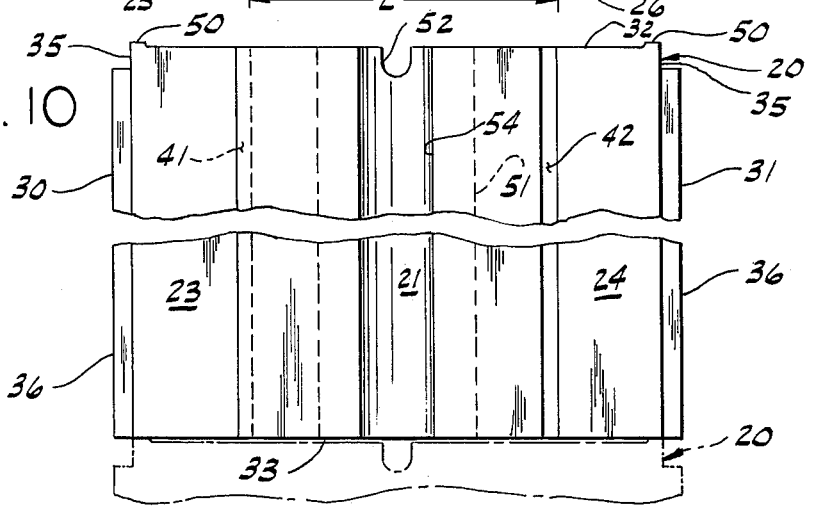
FIG. 10 is a plan view of said block.

As clearly shown in FIG. 10 the end 32 of the block 20 includes laterally spaced projecting bearing portions 50 which facilitate the fit of an adjacent block, such as that shown in phantom outline in FIG. 10, by reducing the surface contact between the ends 32 and 33. It will be understood that blocks 20 can readily be made hollow, where a lighter weight block is desired, by the provision of a longitudinal passage shown in phantom outline by numeral 51. In addition, a centrally located vertical groove 52 can be provided for receiving a threaded rod such as that indicated by numeral 53 in FIG. 1, which is anchored to the foundation 14. Longitudinal, semi-circular grooves 54 can also be provided to accommodate longitudinally disposed reinforcing rods (not shown).

In order to construct a wall 10 of substantially conventional brick bond appearance other blocks are used in addition to block 20 which constitutes a first building block. In particular, such blocks are used for cap, corner and end construction and will now be described with reference to FIGS. 4–8.

Figure 4:
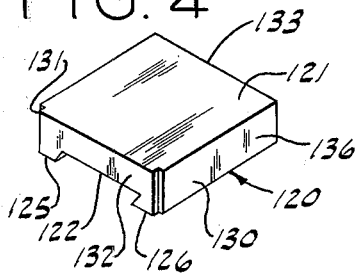
FIG. 4 is a perspective view of a cap building block.

A typical cap block is indicated by numeral 120 in FIG. 4. This cap block 120 is of the same overall length between ends 122 and the same overall width between front and rear sides 130 and 131 as the basic block 20. It is, however, shorter in height than block 20 and is provided with a flat top 121 which is substantially equal to the height of the brick-simulating panel 136 which is of the same height as panel 36 of block 20, and is clearly indicated in FIG. 9 by numeral 121. In other respects the cap block 120 is similar to said block 20 and for convenience corresponding parts are given the same numeral preceded by the numeral 1.

Figure 5:
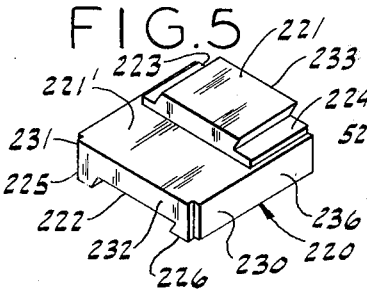
FIG. 5 is a perspective view of a building block used in corner construction.
Figure 6:
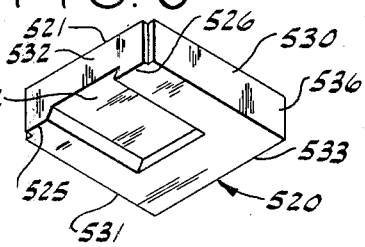
FIG. 6 is a perspective view from the underside of a building block used in end wall construction.
Figure 7:
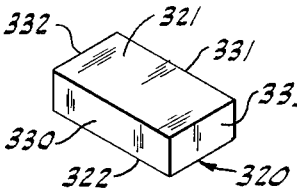
FIG. 7 is a perspective view of a rectangular building block.

The corner construction at the intersection of wall sections 11 and 12 is formed from a conbination of building blocks 220 and 320 as illustrated in FIGS. 5 and 7, said blocks 220 and 320 constituting second and third blocks respectively. Building block 220 is a variation of block 20 and corresponding parts are given the same identifying numeral preceded by numeral 2. Block 220 provides, in effect, only a partial rib 221 and flanking portions 223 and 224 which extend substantially only half the length of said block. The portion of the block 220 extending beyond the rib and flanking portions is cut away to a flat top 221′ at a level corresponding to the upper edge of the side panels 236. This flat top 221′ permits the generally rectangular block 320, shown in FIG. 6, to be utilized as an end block in both a lengthwise and an endwise direction. As shown in FIG. 1 the block 320 is of a length, between ends 332 and 333, and height between upper and lower sides 231 and 322 substantial equal to the length and height of the brick-simulating panel 36 of said basic block 20. The width between the front and rear sides 330 and 331 is approximately half the length of said block, an allowance being made for the width of a mortar strip. The ribless and grooveless building blocks 320 define the vertical corner line, and a mortar pad or other spacer means is provided at the corners, as shown by numeral 100, to compensate for the absence of locking means under said rectangular corner block 320, said blocks being disposed lengthwise and widthwise in successive tiers.

Figure 12:
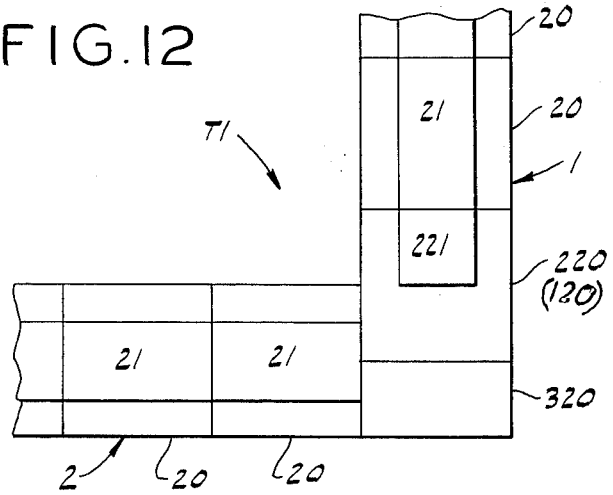
FIG. 12 is a schematic view of a first tier of blocks in a corner construction.
Figure 13:
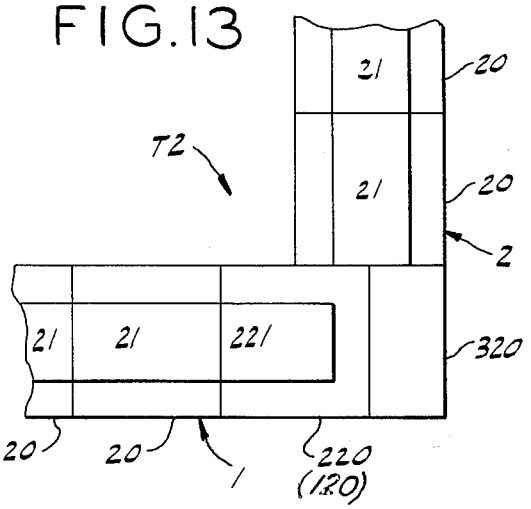
FIG. 13 is a schematic view of a second tier of blocks in a corner construction.

The corner construction can be best understood by reference to FIGS. 12 and 13 which illustrate schematically the arrangement of blocks in vertically alternating first and second tiers, respectively. The first tier T1 includes a plurality of blocks disposed in perpendicularly related rows 1 and 2. Row 1 includes a plurality of blocks 20, a block 220 disposed so that the half rib 221 is continuous with the rib 21 of said block 20, and a block 320 transversely related to said block 220 to define the wall corner. Row 2 includes a plurality of blocks 20 abuting blocks 220 and 320. The second tier T2 is identical to the first tier T1 except that rows 1 and 2 are interchanged. The result is that row 2 of the second tier T2 overlies row 1 of the first tier T1 and the last block 20 is interlocked with block 220 below it. Similarly row 1 of the second tier T2 overlies row 2 of the first tier and block 220 is interlocked with block 20 below it.

As an alternative to the corner construction shown in FIGS. 12 and 13 the cap blocks 120 can be used in lieu of blocks 220. In this event, additional mortar is required because of the absence of the partial rib 221 which is present on block 220.

Figure 8:
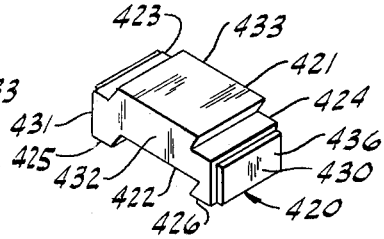
FIG. 8 is a perspective view of a basic half block.
Figure 11:
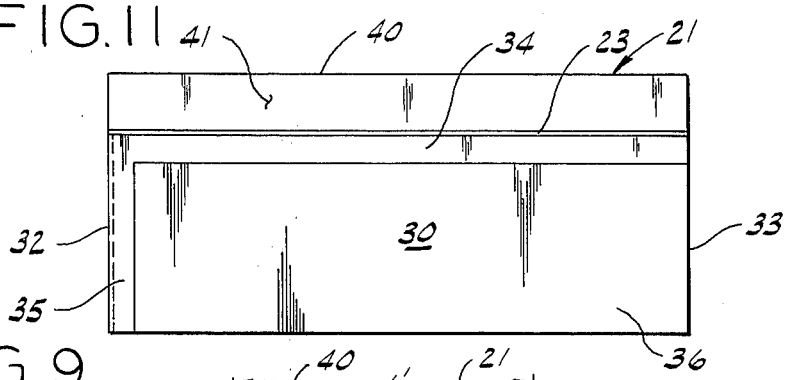
FIG. 11 is a side elevational view of said block.
Figure 9:
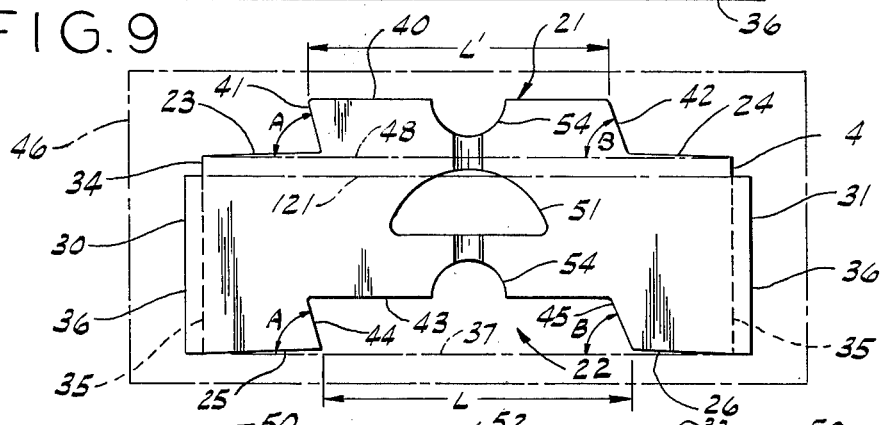
FIG. 9 is an enlarged end elevational view of the basic building block.

As shown in FIG. 1, the end of wall section 13 is formed by using basic blocks 20 in combination with half blocks 420 as shown in FIG. 8 in alternate tiers. The half blocks 420 are of the same cross-sectional configuration as block 20 having an identical overall width between front and rear sides 430 and 431 but are only half the length between ends 432 and 433. The rib 421, groove 422, and contiguous flanking portions 423, 424 and 425, 426 respectively extend from end to end of the block 420 and brick-simulating panels 436 are provided. It will be understood that, although a full cap block 120 is shown as terminating the upper portion of wall section 13, a half block is used as necessary said half block (not shown) having the same configuration as cap block 120 but the same length as half block 420.

FIG. 2 discloses an alternative wall end which does not show the interlocking rib and groove structure. This end wall construction is particularly suitable where doors and windows are to be provided. The construction is formed by using a combination of the plain rectangular block 320 shown in FIG. 7 and building block 520 which is shown in FIG. 6 and constitutes a fourth building block. Essentially, block 520 is a variation of the cap block 120 in that it is provided with a flat top 521 extending between front and rear sides 530 and 531 and ends 532 and 533 and a brick-simulating panel 536. However, the groove 522 and flanking portions 525 and 526 terminate short of the end 533 to provide a plain rectangular appearance at this end. Plain rectangular blocks 320 alternating with blocks 520 are used to complete the end, it being understood that said blocks are separated by mortar or other spacer means. The common bond arrangement, by which, in general, each basic block 20 straddles the abuting ends of the two similar blocks disposed above and below it, is particularly suitable for the wall construction, as will be readily understood. This type of bond, because of the interlocking nature of the blocks provides an extremely stable wall in a horizontal as well as a vertical direction.

I claim as my invention:

1. A building block comprising:

a. an upper side including a longitudinally extending rib having laterally spaced first and second inclined faces and a transverse face extending therebetween, the intersection between said transverse face and said first inclined face defining an acute included angle and the intersection between said transverse face and said second inclined face defining an obtuse included angle, b. a lower side including a longitudinally extending groove having laterally spaced first and second inclined faces and a transverse face extending therebetween, the intersection between said transverse face and said first inclined face defining an acute included angle and the intersection between said transverse face and said second inclined face defining an obtuse included angle said groove receiving the rib of a compatible block in interfitting relation, and c. opposed front and rear sides and opposed ends.

2. A building block as defined in claim 1, in which:

d. the acute included angle of the rib and the acute angle of the groove are substantially equal, and e. the obtuse included angle of the rib and the obtuse angle of the groove are substantially equal.

3. A building block as defined in claim 1, in which:

d. the sum of the acute included angle and the obtuse included angle of the rib is less than two right angles so that said first and second inclined faces converge outwardly.

4. A building block as defined in claim 1, in which:

d. the sum of the acute included angle and the obtuse included angle of the rib is less than two right angles so that said first and second inclined faces converge outwardly, e. the sum of the acute included and the obtuse included angle of the groove is less than two right angles so that said first and second inclined faces converge inwardly, and f. the projected first faces of the rib and groove are parallel and the projected second faces of the rib and groove are parallel.

5. A building block as defined in claim 1, in which:

d. the rib is on the upper side and the groove is on the lower side, and e. said upper and lower sides include longitudinally extending flanking portions adjacent each rib inclined face and each groove inclined face, and said flanking portions slope downwardly away from said rib and said groove.

6. A building block as defined in claim 1, in which:

d. said front side includes a substantially rectangular brick-simulating panel defined in part by relatively recessed right-angularly related margin portions on two margins only.

7. A building block as defined in claim 1, in which:

d. said front and rear sides and ends are substantially vertical, and e. one of said ends includes relatively outstanding bearing portions engageable with the other of said ends.

8. A building block as defined in claim 1, in which:

d. said rib extends substantially the entire length of the block, and e. said groove extends substantially the entire length of the block.

9. A building block as defined in claim 1, in which:

d. said rib extends substantially one half of the entire length of the block, and e. said groove extends substantially the entire length of the block.

10. In a building wall construction:

a. a plurality of first building blocks each including upper and lower sides, front and rear sides and opposed ends, 1. said upper side including a longitudinal rib extending substantially between said ends said rib including laterally spaced first and second inclined faces and a transverse face extending therebetween, the intersection between said transverse face and said first inclined face defining an acute included angle and the intersection between said transverse face and said second inclined face defining an obtuse included angle.

2. said lower side including a longitudinal groove extending substantially between said ends, said groove including laterally spaced first and second inclined faces and a transverse face extending therebetween, the intersection between said transverse face and said first inclined face defining an acute included angle and the intersection between said transverse face and said second inclined face defining an obtuse included angle, said groove receiving the rib of a compatible block in interfitting relation, b. a plurality of second building blocks each including upper and lower sides, front and rear sides and opposed ends, 1. said upper side including a longitudinal rib extending substantially from one of said ends to a point midway between said ends said rib including laterally spaced first and second inclined faces and a transverse face extending therebetween the intersection between said transverse face and said first inclined face defining an acute included angle and the intersection between said transverse face and said second inclined face defining an obtuse included angle, 2. said lower side including a longitudinal groove extending substantially between said ends including laterally spaced first and second inclined faces and a transverse face extending therebetween the intersection between said transverse face and said first inclined face defining an acute included angle and the intersection between said transverse face and said second inclined face defining an obtuse included angle, said groove receiving the rib of a compatible block in interfitting relation, and c. a plurality of third ribless and grooveless building blocks each having a length substantially equal to twice the width thereof, d. said first, second and third building blocks being laid in first and second tiers, 1. the first tier including a plurality of blocks disposed in perpendicularly related rows one of said rows including a plurality of endwise related first blocks, an endwise related second block and terminating with a transversely related third block defining the wall corner, and the other of said rows including a plurality of endwise related first blocks abuting said second and third blocks, 2. the second tier including a plurality of perpendicularly related rows one of said rows including a plurality of endwise related first blocks, an endwise related second block and terminating with a transversely related third block defining the wall corner, and the other of said rows including a plurality of endwise related first blocks abuting said second and third blocks, 3. said other row of said second tier overlying said one row of said first tier, and said other row of said first tier being overlain by said one row of said second tier.

11. A wall construction as defined in claim 10, in which:

e. the front side of said first blocks includes a substantially rectangular, brick-simulating panel defined in part by relatively recessed right-angularly related margin portions, f. the third block includes front and rear sides substantially equal in size to said rectangular brick-simulating panel.

12. A wall construction as defined in claim 10, in which:

e. the front side of said first blocks includes a substantially rectangular, brick-simulating panel defined in part by relatively recessed right-angularly related margin portions, f. the front side of said second block includes a substantially rectangular brick-simulating panel of the same size as said rectangular panel of said first block defined in part by relatively recessed perpendicularly related margin portions spaced from each other, and g. the third block includes a front side substantially equal in size to said rectangular brick-simulating panel.

13. A wall construction as defined in claim 10, in which:

e. a plurality of cap building blocks is provided disposed in an aligned row overlying one of said perpendicularly related rows each including upper and lower sides, front and rear sides and opposed ends, 1. said upper side including a substantially flat face extending substantially between said ends, 2. said lower side including a longitudinal groove extending substantially between said ends, said groove including laterally spaced first and second inclined faces and a transverse face extending therebetween the intersection between said transverse face and said first inclined face defining an acute included angle and the intersection between said transverse face and said second inclined face defining an obtuse included angle, said groove receiving the rib of a compatible block in interfitting relation.

14. A wall construction as defined in claim 10, in which:

d. a plurality of fourth building blocks disposed in vertically aligned alternating relation with third building blocks each including upper and lower sides, front and rear sides and opposed ends, 1. said upper side including a substantially flat face extending substantially between said ends, 2. said lower side including a longitudinal groove extending from one end and terminating short of said other end, said groove including laterally spaced first and second inclined faces and a transverse face extending therebetween the intersection between said transverse face and said first inclined face defining an acute included angle and the intersection between said transverse face and said second inclined face defining an obtuse included angle, said groove receiving part of the rib of a compatible first block in interfitting relation, e. said third building blocks being disposed transversely of said groove and having a lengthwise face vertically aligned with the non-grooved end of said fourth building blocks.

* * * * *